US007845190B2

(12) United States Patent
Pearson

(10) Patent No.: US 7,845,190 B2
(45) Date of Patent: Dec. 7, 2010

(54) TRANSCRITICAL REFRIGERATION CYCLE

(75) Inventor: Stephen Forbes Pearson, Innellan (GB)

(73) Assignee: Star Refrigeration Limited, Glasgow (GB)

( * ) Notice: Subject to any disclaimer, the term of this patent is extended or adjusted under 35 U.S.C. 154(b) by 0 days.

(21) Appl. No.: 10/887,520

(22) Filed: Jul. 8, 2004

(65) Prior Publication Data

US 2005/0044885 A1 Mar. 3, 2005

(30) Foreign Application Priority Data

Jul. 18, 2003 (GB) ..... 0316804.4
Sep. 24, 2003 (GB) ..... 0322348.4

(51) Int. Cl.
*F25B 1/00* (2006.01)

(52) U.S. Cl. ..... 62/502; 62/503; 62/509

(58) Field of Classification Search ..... 62/196.2, 62/217, 228.4, 502, 503, 509, 510, 512
See application file for complete search history.

(56) References Cited

U.S. PATENT DOCUMENTS 4,727,725 A 3/1988 Nagata et al. ..... 62/196.3
5,095,712 A 3/1992 Narreau ..... 62/113
5,603,227 A * 2/1997 Holden et al. ..... 62/193
5,692,389 A 12/1997 Lord et al. ..... 62/222
5,694,784 A * 12/1997 Frey et al. ..... 62/228.5
5,816,055 A * 10/1998 Ohman ..... 62/117
6,047,556 A * 4/2000 Lifson ..... 62/196.2
6,058,729 A * 5/2000 Lifson et al. ..... 62/217
6,138,467 A * 10/2000 Lifson et al. ..... 62/217
6,202,438 B1 * 3/2001 Barito ..... 62/513
6,321,564 B1 11/2001 Yamanaka et al.
6,385,980 B1 * 5/2002 Sienel ..... 62/174
6,428,284 B1 * 8/2002 Vaisman ..... 417/213

(Continued)

FOREIGN PATENT DOCUMENTS

EP 0180904 8/1989

(Continued)

OTHER PUBLICATIONS

Internet Website Extract, www.ari.org/er/tu/1996/9609a.html, "Tech Update: Assessment of Carbon Dioxide as a Refrigerant:", Sep. 1996.

(Continued)

*Primary Examiner*—Mohammad M Ali
(74) *Attorney, Agent, or Firm*—Gifford, Krass, Sprinkle, Anderson & Citkowski, P.C.

(57) ABSTRACT

A transcritical vapour compression refrigeration apparatus including: a compressor, a gas cooler, an economiser, an evaporator and a refrigerant; the refrigerant being compressed in the compressor, heat being rejected from the compressed refrigerant at supercritical pressure in the gas cooler, the cooled compressed refrigerant being then expanded in a first stage to first temperature and pressure conditions in the economiser and then expanded in a second stage to second temperature and pressure conditions; a stream of refrigerant from the economiser at said first temperature and pressure conditions then being compressed in a first stream in the compressor, refrigerant at said second temperature and pressure conditions absorbing heat in the evaporator and then being compressed in a separate second stream in the compressor; said first and second compressed streams then being combined before passing to the gas cooler or passing through separate gas coolers before being combined.

7 Claims, 3 Drawing Sheets

1. COMPRESSOR
2. DRIVE MOTOR
3. CONDENSER
4. DRIER
5. SIGHT GLASS
6. HP EXPANSION VALVE
7. ECONOMISER
8. LP EXPANSION VALVE
9. EVAPORATOR

U.S. PATENT DOCUMENTS

| | | | | |
|---|---|---|---|---|
| 6,474,087 | B1 * | 11/2002 | Lifson | 62/199 |
| 6,571,576 | B1 * | 6/2003 | Lifson et al. | 62/513 |
| 6,705,094 | B2 * | 3/2004 | Alsenz | 62/116 |
| 6,718,781 | B2 * | 4/2004 | Freund et al. | 62/199 |

FOREIGN PATENT DOCUMENTS

| | | | |
|---|---|---|---|
| EP | 0365351 | A3 | 10/1989 |
| EP | 0529882 | A3 | 12/1992 |
| EP | 0778451 | A2 * | 6/1997 |
| EP | 0921364 | A3 | 11/1998 |
| GB | 2180922 | A | 9/1986 |
| GB | 2192735 | A | 5/1987 |
| GB | 2246852 | B | 6/1991 |
| GB | 2286659 | A | 6/1995 |
| JP | 9-170827 | A * | 6/1997 |
| SE | 1 256 391 | | 5/1968 |

OTHER PUBLICATIONS

*Service Tech*, "The Future of Automotive A/C", Ryan Cohen, May 2003.

Huff et al., "Options for a Two-Stage Transcritical Carbon Dioxide Cycle", 2002, pp. 158-164.

Goosmann et al., "Recent Improvements in CO2 Equipment", Refrigerating Engineering, The American Society of Refrigerating Engineers, vol. 16, No. 1, Jul. 1928, pp. 1-10.

* cited by examiner

PRESSURE/ENTHALPY DIAGRAM
FOR PARALLEL COMPRESSION
ECONOMISED CYCLE

1. COMPRESSOR
2. DRIVE MOTOR
3. CONDENSER
4. DRIER
5. SIGHT GLASS
6. HP EXPANSION VALVE
7. ECONOMISER
8. LP EXPANSION VALVE
9. EVAPORATOR

TRANSCRITICAL REFRIGERATION CYCLE

FIELD OF THE INVENTION

The present invention relates to an improved transcritical vapour compression refrigeration system, apparatus and method, and a compressor for use in the apparatus.

BACKGROUND OF THE INVENTION

Vapour compression refrigerating systems can be arranged so that the condensed liquid refrigerant coming from the condenser at high pressure is sub-cooled to an intermediate temperature before being fed to an expansion device. Sub-cooling has the benefit of increasing the refrigerating effect per unit mass of the circulating refrigerant. This will improve the efficiency of the system provided the additional capacity produced is greater than the power increase required to produce it.

Systems which use this effect include two-stage systems with intermediate cooling and liquid pre-cooling, two-stage systems without intercooling but with liquid pre-cooling (such systems are generally known as "economised" systems) and single-stage screw compressor systems which draw a proportion of the refrigerant flow into an "economiser" port as vapour so that the remainder of the refrigerant flow is sub-cooled to economiser pressure

SUMMARY OF THE INVENTION

The technique of economising is particularly appropriate when refrigerants are being employed in ways which result in heat rejection at supercritical pressures, where the latent heat is non-existent. In these regions the use of sub-cooling by the economiser technique can produce increases in refrigerating capacity which are much greater than the extra power required to operate the economiser.

Refrigerants which might be expected to operate at pressures and temperatures in the regions of their critical points include ethylene (R-1150), nitrous oxide (R-744A), ethane (R-170), R507A, R508, trifluoromethane (R-23), R404A, R-410A, R-125, R-32 and carbon dioxide (R-744). It is comparatively easy to produce an economised system using either a screw compressor or a two-stage reciprocating compressor. It is not obvious how the effect of an economiser could be produced when using a single-stage reciprocating compressor. The Haslam Company of Derby patented a system in the 1920s, under which vapour was injected into the cylinder of a reciprocating compressor during the compression process (UK Patent Nos 165929 and 163769). The system does not seem to have been a commercial success.

Generally speaking, the following patent specifications disclose economised refrigeration systems: GB 2246852, GB 2286659, GB 2192735, GB 2180922, GB 1256391, EP 0529882, EP 0365351, U.S. Pat. No. 5,692,389, U.S. Pat. No. 5,095,712, U.S. Pat. No. 4,727,725 and EP 0921364. Single or multi-stage compression may be employed, but where compression is in multiple stages these operate in series.

Patent specification EP 0180904 discloses compression of parallel streams of vapour. However, this occurs at sub-critical pressures.

Use of carbon dioxide as a refrigerant for air conditioning fell out of use in the 1930s because it was simpler, cheaper and more efficient to use substances like R-12.

The main reason for lower efficiency of carbon dioxide systems is the low critical temperature of the refrigerant.

The effects of low critical temperature can be mitigated to some degree by using two-stage compression and an economiser to produce sub-cooling of the liquid refrigerant. However, the pressure ratios associated with systems for air conditioning are lower than would justify the adoption of two-stage compression.

The present invention broadly provides a transcritical vapour compression refrigerating system where refrigerant vapour is compressed to supercritical discharge pressure in two separate non-mixing streams, one coming from an economiser and the other coming from the main evaporator.

Thus, the present invention provides a transcritical vapour compression refrigeration apparatus which comprises;

- a compressor, a gas cooler, an economiser, an evaporator and a refrigerant;
- the refrigerant being compressed in the compressor, heat being rejected from the compressed refrigerant at supercritical pressure in the gas cooler, the cooled compressed refrigerant being then expanded in a first stage to first temperature and pressure conditions in the economiser and then expanded in a second stage to second temperature and pressure conditions;
- a stream of refrigerant from the economiser at said first temperature and pressure conditions then being compressed in a first stream in the compressor;
- refrigerant at said second temperature and pressure conditions absorbing heat in the evaporator and then being compressed in a second stream in the compressor;
- said first and second compressed streams then being combined before passing to the gas cooler; or the first and second compressed streams passing through separate gas coolers before being combined.

The present invention relates in one embodiment to a system whereby the beneficial effects of economising can be obtained when using single-stage reciprocating compressors.

The term "gas cooler" is appropriate for a heat rejection device operating at transcritical pressures (i.e. from a supercritical to a subcritical pressure) since heat rejection does not result in liquifaction of refrigerant (as it does in a "condenser" operated at subcritical pressure). Thus, the term gas cooler has the same meaning as a condenser operating at supercritical pressure.

Thus, one embodiment of the invention consists of a transcritical vapour compression refrigeration system except that the single-stage reciprocating compressor, which is an essential component of the system, in the present invention, has some cylinders dedicated to the compression of refrigerant vapour being drawn from the evaporator to produce a refrigerating effect, and some cylinders dedicated to the compression of refrigerant vapour drawn from an economiser intermediate the first and second stages of expansion, to produce an increase of the refrigerating effect per unit mass of the refrigerant flowing through the evaporator It is a surprising feature of the invention that, even when heat rejection is at transcritical pressures, the increase in refrigerating effect more than compensates for the extra power required to compress the refrigerant vapour from the economiser. The increased refrigerating effect derives from further cooling of the refrigerant in the economiser due to refrigerant vapourisation before the second expansion stage.

It is also surprising that the increased refrigerating effect, under certain conditions, also more than compensates for the reduction in apparently useful swept volume resulting from the dedication of some cylinders to compressing vapour from the economiser. The refrigerant capacity of the compressor, arranged so that only some of the cylinders draw refrigerant vapour from the main evaporator, is greater than if all cylinders had been arranged to draw vapour from the evaporator.

It can be shown that, for each compressor suction and discharge pressure, there is an optimum economiser pressure to produce maximum efficiency. The optimum economiser pressure corresponds to a particular ratio between the swept volume of cylinders dedicated to the main evaporator and the swept volume of cylinders dedicated to the economiser. The sets of cylinders compress two streams of refrigerant vapour in parallel, from evaporating pressure and from economiser pressure, to a common discharge pressure.

Although the invention is described with reference to a reciprocating compressor, the benefits of the invention can also be obtained with other types of compressor (e.g. centrifugal compressors, scroll compressors, screw compressors etc.) arranged to compress the two separate streams of vapour. Two such rotational compressors could be on a single rotating shaft.

The compressor is, however, preferably a reciprocating compressor having at least two cylinders, one for the first stream and one for the second stream. Generally, the cylinder swept volume for the first stream is less than that of the second stream (the main stream from the evaporator to provide cooling). Depending on the temperatures and pressures involved, the ratio of swept volume of the second stream to the first stream is preferably in the ratio of 1.1-11 to one, especially 1.3-2.5 to one. A preferred ratio is 1.4-1.8 to one. For air conditioning applications, a ratio of 2-3 to one is preferred. For freezing uses, a ratio of 5-7 to one is preferable. With a reciprocating compressor a ratio of 2 to one can be achieved by using a three cylinder compressor, two cylinders being dedicated to the second stream from the evaporator and one cylinder to the first stream from the economiser (the cylinders having identical swept volumes). Similarly, six cylinders can give a 5 to one swept volume ratio. Eight and twelve cylinders can give ratios of 7 to one and 11 to one respectively. Alternatively, the cylinders may have differing swept volumes. In this way, any desired ratio can be achieved.

The first and second compressed streams may be combined before passing to the gas cooler; or the separate streams could pass through separate gas coolers before being combined (or indeed could be combined part-way through the heat rejection stage). It is preferred, though, that the streams are combined before the first stage expansion step occurs.

Economiser constructions are well known to those skilled in the art. In essence, an economiser produces cooling by flashing-off a portion of the main liquid stream, thereby cooling it. Generally, the economiser is a vessel through which the main refrigerant flow to the evaporator passes; a portion being boiled off in a separate stream and thereby producing a cooling effect. Alternatively, the cooling effect may be applied indirectly to the main refrigerant stream by heat exchange e.g. in concentric tubes.

The preferred refrigerant is carbon dioxide (R-744). Other possible refrigerants include ethylene (R-1150), nitrous oxide (R-744A), ethane (R170), R-508 (an azeotrope of R-23 and R-116), trifluoromethane (R-23), R-410A (an azeotrope of R-32 and R-125), pentafluoroethane (R-125), R404A (a zeotrope of R125, R143a and R134a), R507A (an azeotrope of R125 and R143a) and difluoromethane (R-32).

Heat rejection in the gas cooler is typically at supercritical pressures, especially for carbon dioxide (R-744). The cooled refrigerant is generally at subcritical pressure.

The invention also relates to a compressor designed for the refrigeration apparatus; and to a method of refrigeration.

BRIEF DESCRIPTION OF THE DRAWINGS

Embodiments of the invention will now be described with reference to the drawings and supported by an Example which includes theoretical calculations. In the drawings.

DETAILED DESCRIPTION OF THE PREFERRED EMBODIMENTS

Figure 1:
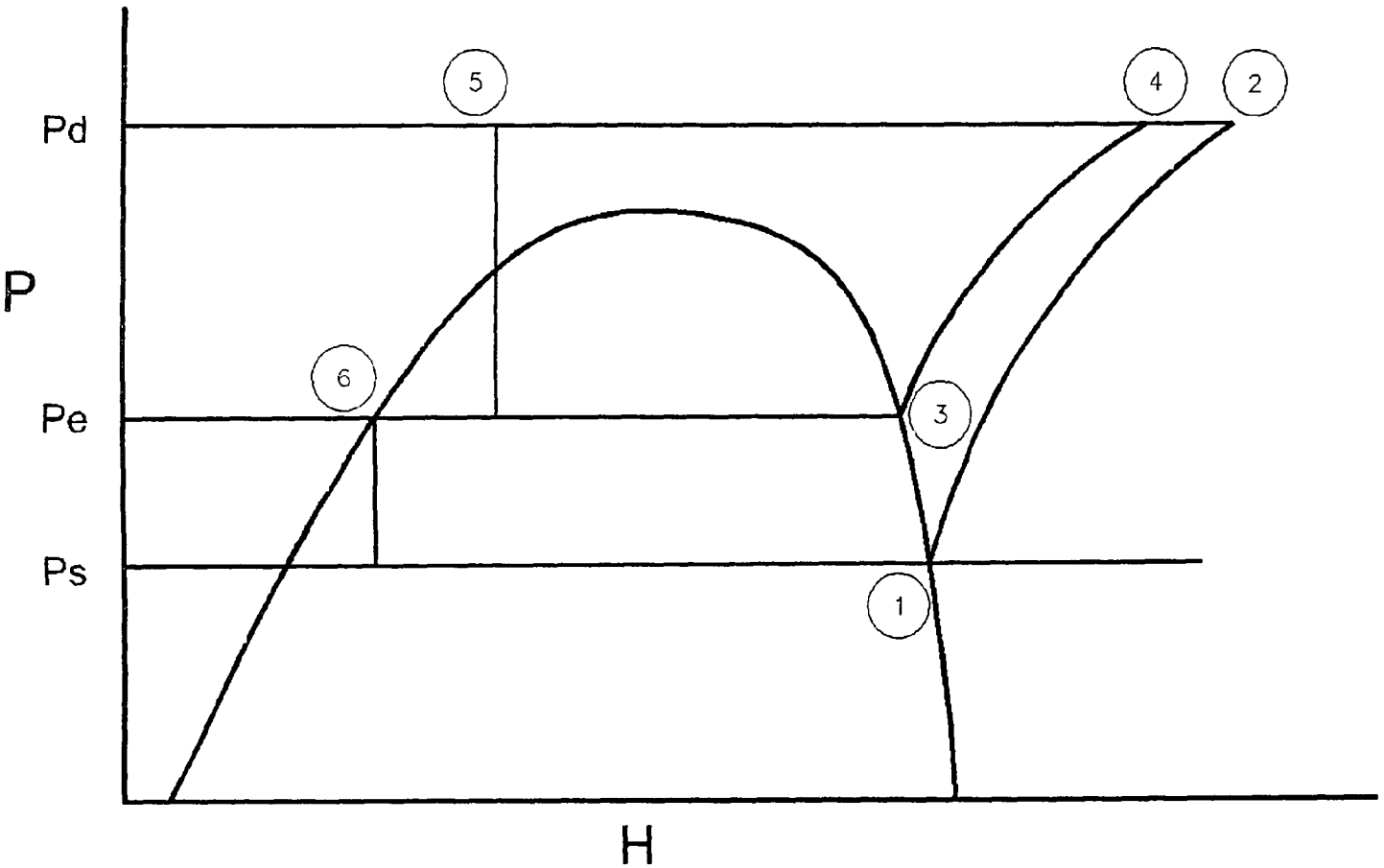
FIG. 1 is a pressure/enthalpy diagram for operation of the transcritical apparatus of the invention.

The novel transcritical refrigerating cycle can be illustrated on a pressure/enthalpy diagram as indicated in FIG. 1. In this diagram, the following points are labelled:

(1) is the point at which refrigerant vapour is drawn into the compressor from the main evaporator.

(2) is the point at which vapour is discharged from the cylinders dedicated to the evaporator.

(3) is the point at which refrigerant vapour is drawn into the compressor from the economiser.

(4) is the point at which vapour is discharged from the cylinders dedicated to the economiser.

(5) is the point to which the mixed streams of vapour at supercritical compressor discharge pressure are cooled by heat rejection (in the gas cooler) at discharge pressure.

(6) is the point to which the liquid refrigerant flowing to the evaporator is cooled by evaporation of liquid refrigerant in the economiser.

Figure 2:
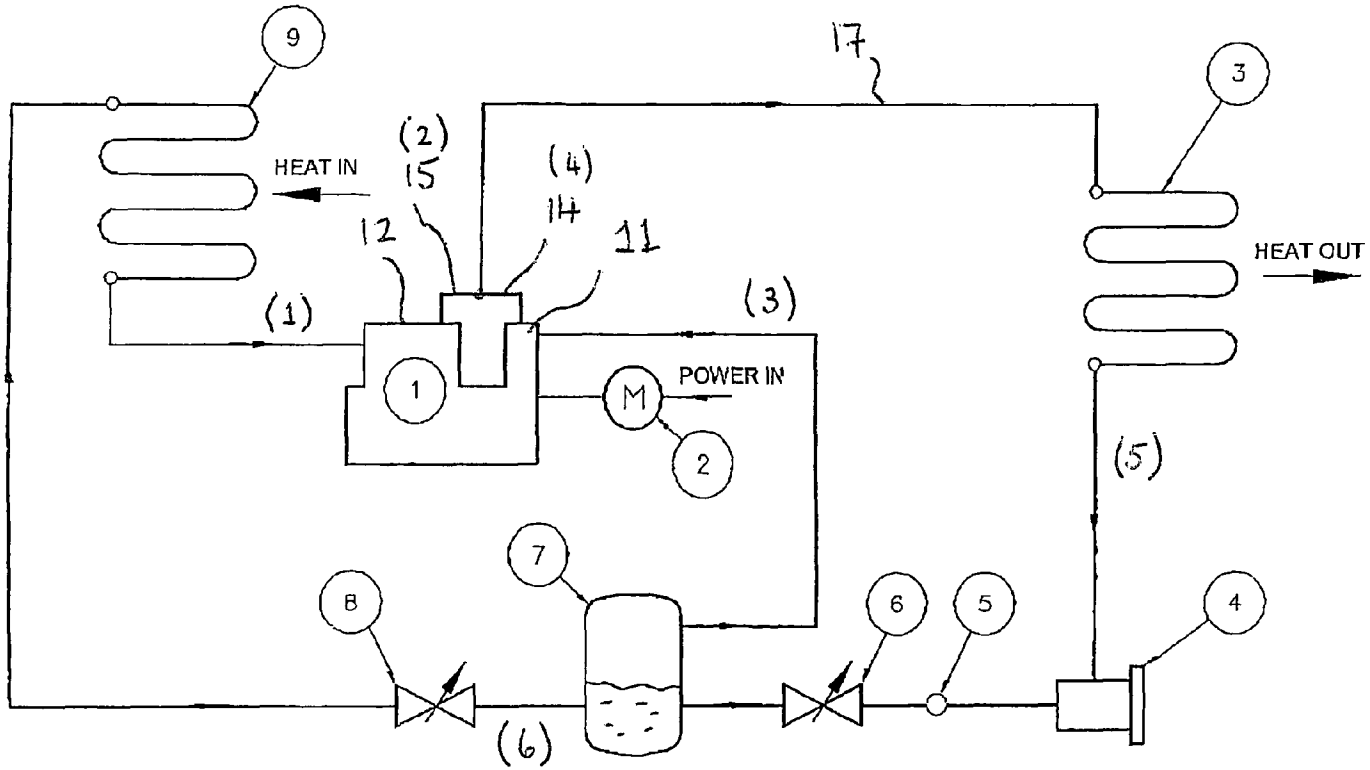
FIG. 2 is a schematic diagram of a preferred embodiment.

For clarity, the corresponding points are marked on FIG. 2 as (1) to (6).

The refrigerating effect is the enthalpy at point (1) minus the enthalpy at point (6) ($H_1$-$H_6$). It can be seen that ($H_1$-$H_6$) is greater than ($H_1$-$H_5$).

It is common practice to seek improvements in refrigerating system efficiency by arranging a degree of heat exchange between high pressure refrigerant at point 5 and cool suction vapour at point 1. It has been found that, in the parallel compression system, there are no significant advantages to be gained from such heat exchange; but the invention could include systems with such heat exchange.

By way of illustration a circuit diagram of a parallel compression refrigerating system is shown in FIG. 2.

FIG. 2 shows a reciprocating compressor 1 having a cylinder 11 for compressing a stream of refrigerant vapour from an economiser 7; and one or more further cylinders 12 for compressing a second stream of refrigerant vapour from an evaporator 9 (providing the cooling effect). The respective compressed streams 14 and 15 are then united into a stream 17 at supercritical pressure going to a gas cooler 3 where heat is rejected. The cooled refrigerant then passes to a drier 4, a sight glass 5 and then to a high pressure expansion valve 6, where a first stage expansion occurs.

The expanded refrigerant passes into an economiser vessel 7 containing refrigerant liquid and vapour. Cold high pressure vapour passes from the economiser to the suction inlet (not shown) of cylinder 11.

The liquid refrigerant passes to a low pressure expansion valve 8 where a second stage of expansion occurs, before the refrigerant passes into the evaporator 9 where a cooling effect is achieved. This second refrigerant stream then passes to the cylinder(s) 12 of the compressor, and the cycle repeats.

FIG. 2 illustrates only one embodiment of the invention. Those skilled in the art would be able to design other embodiments where, for example, the main flow of refrigerant liquid was not reduced to economiser pressure but cooled by heat exchange with liquid in the economiser. Alternatively, the function of the economiser might be performed by heat exchange within concentric tubes without need for an economiser vessel as illustrated.

Example

The method makes use of a single-stage, multi-cylinder, reciprocating compressor having two suction ports; one connected to the evaporator outlet and the other to an economiser designed to cool the main liquid flow. Compression of the two streams of refrigerant vapour takes place in parallel. The refrigerant streams do not mix until they reach discharge pressure at the compressor outlet.

Swept volumes associated with the individual suction connections are arranged to optimise performance at the intermediate pressure which gives highest efficiency.

Calculations

The following assumptions are made:

Evaporating Temperature +5° C., equivalent to 40 Bar A.

Heat rejection at a pressure of 90 Bar A.

Supercritical discharge fluid cooled to 32° C. from discharge temperature.

No superheating of suction vapour.

Economising by evaporation of liquid refrigerant at econonomiser pressure but vapour produced is drawn into a separate compression process and not mixed with the main flow of refrigerant from the evaporator till after compression.

Refrigerant vapour from the evaporator is drawn into the suction port of the compressor and compressed in cylinders having appropriate swept volume for the purpose. At the same time, refrigerant vapour from the economiser is drawn into a separate set of cylinders at intermediate pressure and compressed to discharge pressures. The two streams of compressed refrigerant vapour are mixed at discharge pressure and piped to a high pressure heat exchanger where heat is rejected from the system. The heat rejection is at supercritical pressure. From the high pressure gas cooler, the refrigerant passes to a first stage expansion valve, where the pressure is reduced to economiser pressure. In the economiser, a portion of the refrigerant flow is evaporated and drawn to the economiser connection on the compressor. The remainder of the refrigerant is cooled as liquid to the saturation temperature corresponding to economiser pressure. The cooled liquid is then expanded to evaporator pressure through a second stage expansion valve. The refrigerant then passes through the evaporator, where heat is absorbed, and then to the suction port of the compressor, where the cycle recommences.

Cooling refrigerant liquid in the economiser results in an increase of refrigerating effect, which more than compensates for the power absorbed in the economiser section of the compressor. Thus the coefficient of performance (CoP) of the refrigerating system is increased.

The amount by which the CoP can be increased depends on the pressure ratio of the system, on the economiser pressure and the refrigerant temperature after heat rejection. Economiser pressure depends on the relative swept volumes of the compression streams of the compressor.

The process can be illustrated on a Mollier Diagram (FIG. 1).

By way of example a calculation follows, showing the performance of a system operating in accordance with the previous assumptions, having an economiser pressure of 55 Bar A (18° C.) and assumed compression efficiency of 0.7.

From the Mollier Diagram and associated tables (not shown) it can be deduced that:

H1=731 (kJ/kg

H2=776

H3=715

H4=735

H5=588

H6=552

If it is assumed that the ratio of flow through the main evaporator to flow of refrigerant vapour from the economiser is as 1 is to x, then, H6+x.H3=H5.(1+x) from which it follows that $$x=36/127=0.28$$

Refrigerating effect is H1-H6=179 kJ/Kg

Total power consumption is x(H4−H3)+(H2−H1)=51 kJ/kg

Therefore CoP=179/51=3.5

The calculation was repeated for various economiser pressures for systems with discharge pressure at 90 Bar A and evaporating temperature of +5° C. (40 Bar A).

Figure 3:
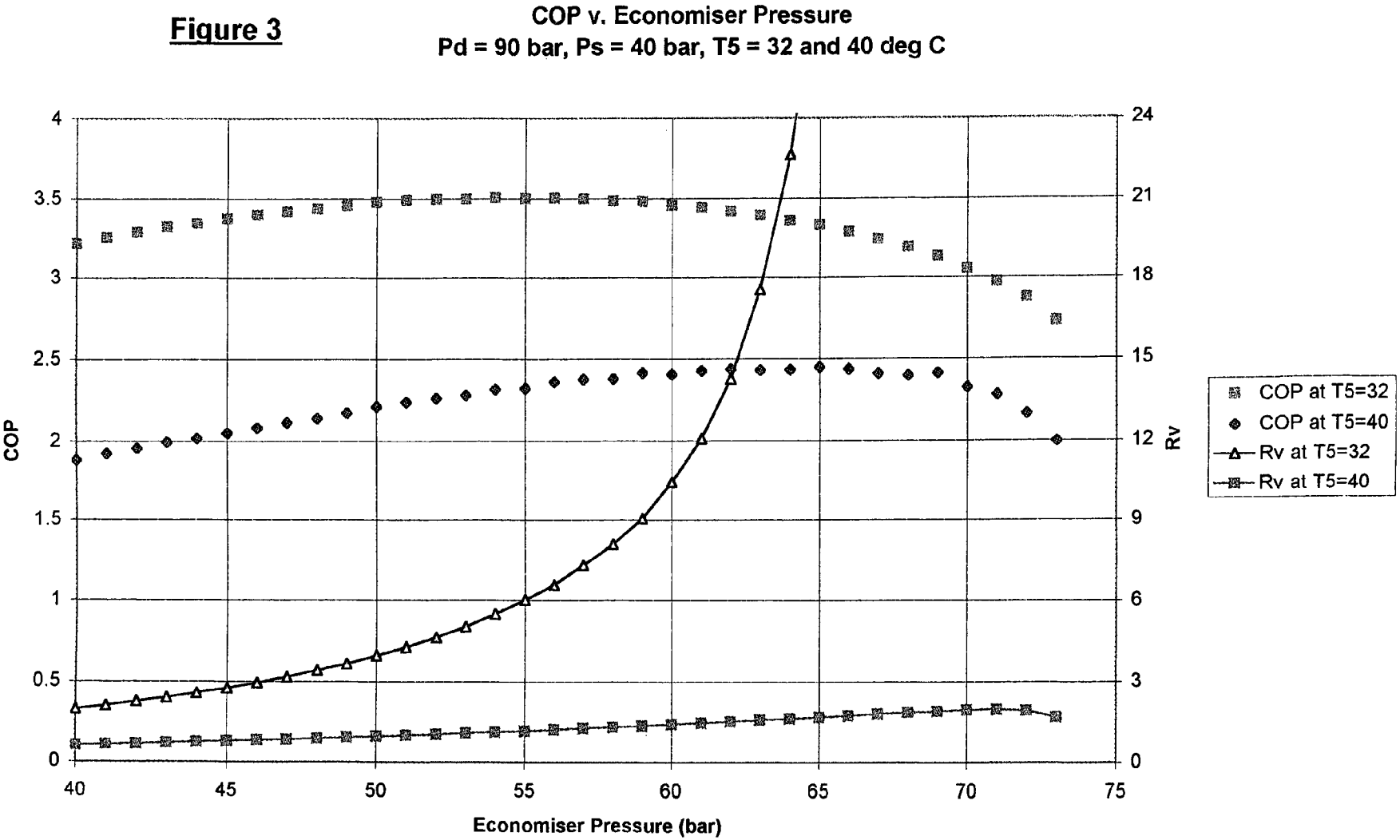
FIG. 3 is a graph of Coefficient of Performance (CoP) versus Economiser Pressure for a number of scenarios.

The curve of CoP versus economiser pressure is shown in FIG. 3 for exit temperatures T5 (temperature at point (5) in FIG. 1) from the heat rejection process of 32° C. and 40° C.

Ratio of Swept Volumes

It is possible to calculate the ratio of cylinder swept volumes as follows:

Consider volumes pumped at 18° C. economising.

Mass flow is 0.28:1

$V_s$ at +5° C.=0.0087296 $m^3$/kg Pressure ratio 90/40=2.25 therefore V effy 0.90

$V_s$ at +18° C.=0.0055647 $m^3$/kg Pressure ratio 90/54=1.65 therefore V effy 0.95

(V effy is volumetric efficiency)

Therefore volumes to be swept are:

At +5° C. 0.0087269/0.9=0.0097 $m^3$/kg

At +18° C. (0.0055647)(0.28)/0.95=0.00165 $m^3$/kg

Therefore ratio of swept volumes=97/16.5=5.9

This is the ideal volume ratio for maximum efficiency under these conditions.

However a volumetric ratio of 5.9 to 1 is not really practicable. A ratio of 7 to 1 could be obtained from an eight cylinder compressor. Calculations show that the economiser pressure would rise to about 57 Bar A (20° C.) and the CoP would become about 3.45.

Performance

A simple single-stage, transcritical, carbon dioxide compressor system operating between +5° C. and 90 Bar A, with suction vapour superheated to +20° C., would give a CoP of 2.19.

Comparison of this figure with a 7:1 swept volume ratio PCE system shows a CoP improvement of 3.45/2.19=1.57 say 55%.

Refrigerating effect of the known simple, single stage, system having eight compression cylinders can be considered as proportional to:

8(730.58−588)=1141 kJ/kg.

Refrigerating effect of the seven main suction cylinders of an eight cylinder PCE system according to the invention can be considered as proportional to:

7(730.58−552)=1250 kJ/kg.

It can be seen that the reduction in number of cylinders connected to the evaporator is more than compensated for by the increase in refrigerating effect. Improvement in refrigerating effect=1250/1141=1.095, say 10%.

For comparison, calculations on the performance of a single stage R-134a system, operating between +5° C. and +55° C., with a compression efficiency of 0.7, indicate that the refrigerating effect per kg would be 122.1 kJ/kg; the work per kg pumped would be 42.557, giving a CoP of 2.87.

The results of the foregoing calculations can be summarised in tabular form:

| | Evap °C. | $V_s$ $m^3$/Kg | Cond °C. | Disch P Bar A | P Ratio R | RE/Kg KJ | Work/Kg KJ | CoP |
|---|---|---|---|---|---|---|---|---|
| R-134a | 5 | 0.058 | 55 | 15 | 4.27 | 122 | 43 | 2.87 |
| R-744 | 5 | 0.0087 | — | 90 | 2.25 | 97.29 | 44 | 2.19 |
| R-744-E | 5 | 0.0087 | — | 90 | 2.25 | 179 | 51 | 3.5 |

CONCLUSIONS (1) The use of the parallel compression economiser (PCE) system according to the invention on transcritical carbon dioxide refrigerating systems can result in efficiencies comparable to those which would have been achieved using R134a.

(2) The use of the PCE system, having one of eight cylinders dedicated to the economiser, results in an increase of refrigerating effect compared to what would have been achieved using all eight cylinders in a non-economised system.

(3) The swept volume required to produce the same refrigerating effect is 15% of that which would be required when using R134a. Allowing for the economiser cylinder increases the figure to 20% for the proposed cycle.

(4) The proposed PCE system will have wide application for automotive air conditioning, window air conditioners and small water chillers, where it is not appropriate to use screw or scroll compressors.

The invention claimed is:

1. A transcritical vapour compression refrigeration apparatus which comprises:

a reciprocating refrigerant compressor, a gas cooler, an economiser, an evaporator and carbon dioxide (R-744);

said compressor being operative to compress to supercritical pressure the carbon dioxide in two separate streams, said gas cooler being operative to reject heat from the compressed carbon dioxide at supercritical pressure in the gas cooler, said evaporator being operative to expand the cooled compressed carbon dioxide in a first stage to first temperature and pressure conditions in the economiser and further expanding said carbon dioxide in a second stage to second temperature and pressure conditions;

said compressor being further operative to compress to supercritical pressure a stream of carbon dioxide from the economiser at said first temperature and pressure conditions to form a first stream in the compressor;

and to compress to said supercritical pressure a second stream of carbon dioxide at said second temperature and pressure condition after having absorbed heat in the evaporator;

said apparatus being further operative to combine said first and second compressed streams at said supercritical pressure before one of passing said combined streams to the gas cooler and passing said first and second streams through separate gas coolers before being combined.

2. An apparatus according to claim 1, wherein the reciprocating refrigerant compressor further comprises a reciprocating compressor having at least two cylinders including a first cylinder for compressing the first stream and a second cylinder for compressing the second stream.

3. An apparatus according to claim 2 wherein the ratio of swept volume of the second stream to the first stream is in the ratio of 1.1-11 to one.

4. An apparatus according to claim 2 wherein the ratio of swept volume of the second stream to the first stream is in the ratio of 2-3 to one.

5. An apparatus according to claim 2 wherein the ratio of swept volume of the second stream to the first stream is in the ratio of 5-7 to one.

6. An apparatus according to claim 2 wherein the ratio of swept volume of the second stream to the first stream is in the ratio of 1.3-2.5 to one.

7. An apparatus according to claim 1 further comprising two suction ports connecting to respective cylinders having a ratio of swept volumes selected to produce improved efficiency when used to compress said refrigerant vapour to discharge pressure.

* * * * *